US012221779B2

(12) United States Patent
Yin et al.

(10) Patent No.: US 12,221,779 B2
(45) Date of Patent: Feb. 11, 2025

(54) FLUSHING SWITCH DEVICE WITH AUTOMATIC PRESSING STROKE DETECTION

(71) Applicant: Taiwan Name Plate Co., Ltd., Taoyuan (TW)

(72) Inventors: Wen-Cheng Yin, New Taipei (TW); Fu-Jung Cheng, New Taipei (TW); Ho-Chuan Hsu, New Taipei (TW); Yu-Hsun Tseng, Taoyuan (TW); Chao-Chin Chang, New Taipei (TW); Kai-Li Peng, Taoyuan (TW)

(73) Assignee: Taiwan Name Plate Co., Ltd., Taoyuan (TW)

( * ) Notice: Subject to any disclaimer, the term of this patent is extended or adjusted under 35 U.S.C. 154(b) by 197 days.

(21) Appl. No.: 18/182,652

(22) Filed: Mar. 13, 2023

(65) Prior Publication Data

US 2023/0399833 A1 Dec. 14, 2023

(30) Foreign Application Priority Data

Jun. 9, 2022 (TW) ..... 111206071

(51) Int. Cl.
*E03D 5/10* (2006.01)

(52) U.S. Cl.
CPC ..... *E03D 5/105* (2013.01)

(58) Field of Classification Search
CPC ..... E03D 5/105; E03D 5/10
USPC ..... 4/249
See application file for complete search history.

(56) References Cited

U.S. PATENT DOCUMENTS

2009/0121171 A1* 5/2009 Parsons ..... E03D 3/02 137/511
2010/0252759 A1* 10/2010 Guler ..... F16K 31/02 340/3.1
2011/0155934 A1* 6/2011 Guler ..... E03D 3/06 251/129.04
2013/0186196 A1* 7/2013 Veros ..... E03D 5/105 73/304 C

* cited by examiner

*Primary Examiner* — Huyen D Le
(74) *Attorney, Agent, or Firm* — Wang Law Firm, Inc.

(57) ABSTRACT

A flushing switch device with automatic pressing stroke detection is provided, which is applied to the flushing switches of a toilet. The flushing switch device with automatic pressing stroke detection includes a capacitive sensor, an actuator, and a protector. The capacitive sensor senses a user's hand movements to generate a sensing signal. The actuator includes a driver and a pressing mechanism; the driver drives the pressing mechanism to press one of the flushing switches. The protector includes a detector and a controller; the detector detects a load variation during an operation of the actuator to generate a detection signal; the controller receives the sensing signal and correspondingly generates a control signal to control the actuator according to the sensing signal and the detection signal.

5 Claims, 2 Drawing Sheets

FLUSHING SWITCH DEVICE WITH AUTOMATIC PRESSING STROKE DETECTION

CROSS-REFERENCE TO RELATED APPLICATION

This application claims priority from Taiwan Patent Application No. 111206071, filed on Jun. 9, 2022, in the Taiwan Intellectual Property Office, the content of which is hereby incorporated by reference in its entirety for all purposes.

BACKGROUND OF THE INVENTION

1. Field of the Invention

The present disclosure relates to a flushing switch device, particularly a flushing switch device for a non-contact toilet.

2. Description of the Related Art

Contact infection includes direct contact infection and indirect contact infection. In the prevalence of epidemics, to avoid contact infection, it is a critical issue to reduce the possibility of making contact with objects in public spaces. However, on a daily basis, there are many objects that cannot be avoided, such as flushing switches of a toilet. Although items such as keys, pen tips, or cell phones can be used to press switches, they still come into contact with objects in public spaces, which causes the problem of indirect contact infection. Alternatively, disinfection can be done by washing hands immediately after touching objects in public spaces to cut off routes of infection. However, not only are the above methods inconvenient, but the routes of infection are also not effectively blocked. Therefore, there is a need for a flushing device that allows a user to press the flushing switches of a toilet without making contact.

In addition, there are many brands and models of toilet devices on the market, and different brands or models of toilets have different pressing strokes of flushing switches. Therefore, the aforementioned flushing devices that can be used to flush toilets by pressing the flushing switches without making contact may not be suitable for toilets with different models or specifications. For instance, when the flushing switches of toilets have a pressing stroke smaller than that of the pressing devices, this may lead to problems like damage to the driving components of the pressing devices, such as motors, etc. Moreover, when the flushing switches of toilets have a pressing stroke larger than that of the pushing devices, this may lead to problems such as failing to press the flushing switches of toilets with certainty.

Hence, how to design a device that can be installed on the flushing switches of toilets is an important issue for the inventor of the present disclosure, thus realizing the function of pressing the flushing switches of toilets to flush without making contact, which is suitable for toilets with different models or specifications, so as to solve the technical problems in the prior art.

SUMMARY OF THE INVENTION

In view of the aforementioned conventional problems, the purpose of the present disclosure is to provide a flushing switch device with automatic pressing stroke detection to protect related elements that drive the pressing in order to solve the problems that may be encountered in the prior art.

Based on the above purposes, the present disclosure provides a flushing switch device with automatic pressing stroke detection for pressing two flushing switches of a toilet, wherein the two flushing switches respectively correspond to different flushing amounts of water. The flushing switch device with automatic pressing stroke detection includes a capacitive sensor, a actuator, and a protector. The capacitive sensor senses a user's hand movements to generate a sensing signal. The actuator includes a driver and a pressing mechanism; the driver drives the pressing mechanism to press one of the flushing switches. The protector is electrically connected to the capacitive sensor and the actuator, and the protector includes a detector and a controller; the detector detects a load variation during an operation of the actuator to generate a detection signal; the controller receives the sensing signal and correspondingly generates a control signal to control the actuator according to the sensing signal and the detection signal.

Preferably, the protector includes a detection mode and an operational mode; when in the detection mode, the controller stores operational information at the load variation, and when in the operational mode, the controller controls the actuator according to the sensing signal and the control signal corresponding to the operational information.

Preferably, the load variation is a variation in voltage or current values of the driver.

Preferably, the operational information includes voltage or current values at the time of variation and a time value from a start of an operation to a variation in voltage or current values; the controller correspondingly generates the control signal to control the actuator according to the sensing signal and the time value.

Preferably, the load variation is a variation in voltage or current values of the driver, and when the controller determines a variation in voltage or current values to be the voltage or current values greater than originally performed voltage or current values of the driver, the controller controls the driver to stop operation.

The technical features of the present disclosure are to be described in detail below with specific embodiments and accompanying drawings to make a person with ordinary skill in the art effortlessly understand the purpose, technical features, and advantages of the present disclosure.

BRIEF DESCRIPTION OF THE DRAWINGS

The drawings required for the description of the embodiments of the present disclosure are to be briefly described below to illustrate more clearly the technical solutions of the embodiments of the present disclosure. It is obvious that the accompanying drawings described below are only some embodiments of the present disclosure. For a person with ordinary skill in the art, additional drawings may be obtained according to these drawings.

DESCRIPTION OF THE PREFERRED EMBODIMENTS

To facilitate the understanding of the technical features, contents, advantages, and achievable effects of the present disclosure, the embodiments together with the accompanying drawings are described in detail as follows. However, the drawings are used only for the purpose of indicating and supporting the specification, which is not necessarily the real proportion and precise configuration after the implementation of the present disclosure. Therefore, the relations of the proportion and configuration of the accompanying drawings should not be interpreted to limit the actual scope of implementation of the present disclosure.

In addition, the terms "include" and/or "contain" are used to indicate the presence of features, regions, entirety, steps, operations, elements and/or components, but may not exclude the presence or addition of one or more of other features, regions, entirety, steps, operations, elements, components, and/or combinations thereof.

Unless otherwise defined, all terms (including technical and scientific terms) used in the present disclosure have the same meaning as those commonly understood by a person with ordinary skill in the art. It may be understood that, unless explicitly defined herein, the terms such as those defined in commonly used dictionaries should be interpreted as having definitions consistent with their meaning in the context of the related art and the present disclosure, and should not be construed as idealized or overly formal.

Figure 1:
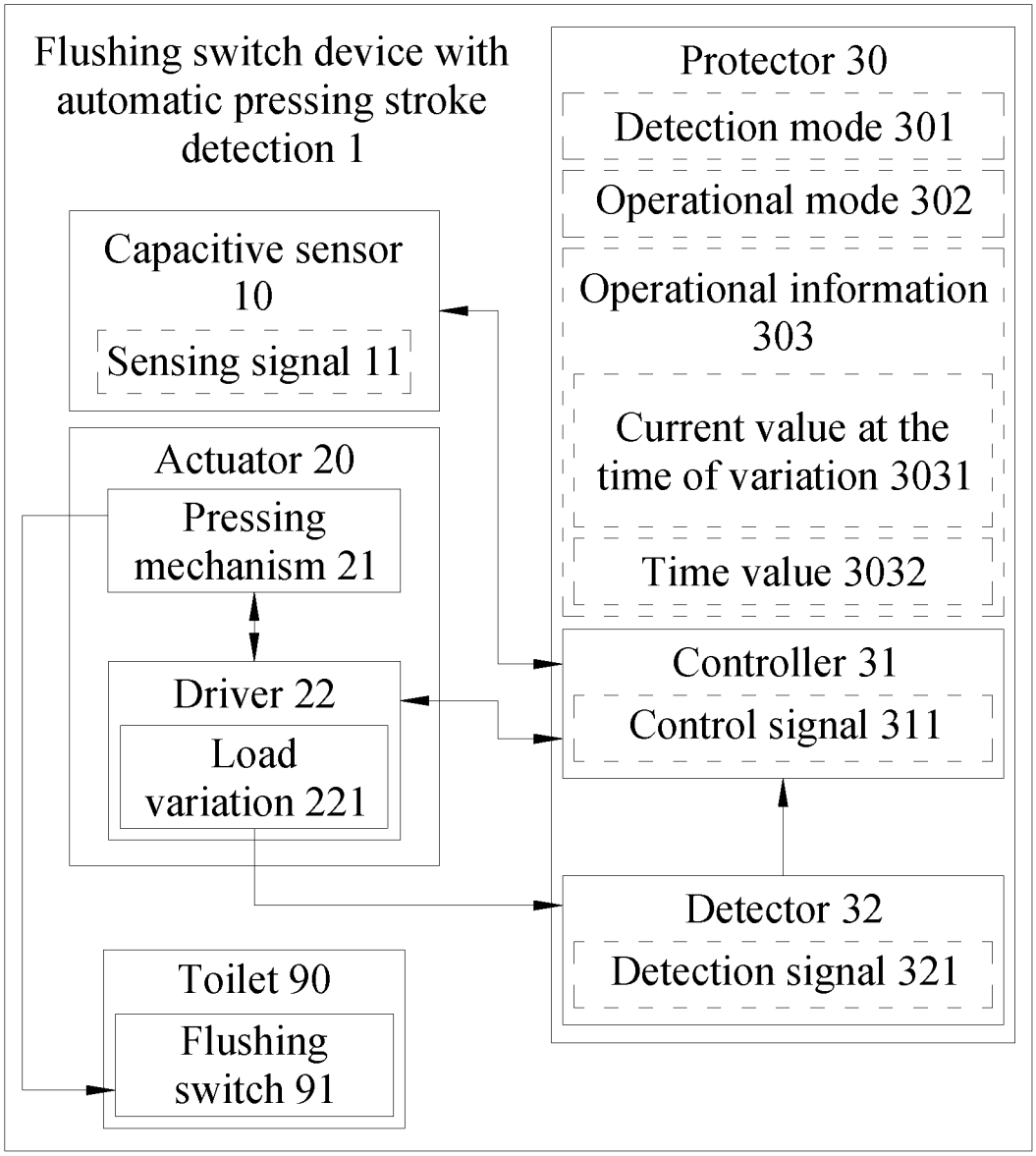
FIG. 1 is a schematic block diagram of the flushing switch device with automatic pressing stroke detection according to the first embodiment of the present disclosure.

Please refer to FIG. 1. FIG. 1 is a schematic block diagram of the flushing switch device with automatic pressing stroke detection according to the first embodiment of the present disclosure.

As shown in the figure, the present disclosure provides a flushing switch device with automatic pressing stroke detection 1, which is suitable for pressing two flushing switches 91 of a toilet 90, wherein the two flushing switches 91 respectively correspond to different flushing amounts of water. The flushing switch device with automatic pressing stroke detection 1 includes a capacitive sensor 10, a actuator 20, and a protector 30.

Wherein, the capacitive sensor 10 senses a user's hand movements to generate a sensing signal 11. Wherein, the actuator 20 includes a driver 22 and a pressing mechanism 21. The driver 22 drives the pressing mechanism 21 to press one of the flushing switches 91.

It is worth mentioning that in each of the embodiments of the present disclosure, the technical means such as the capacitive sensor and the actuator, which are described in the patent application "Flushing Switch Device For Toilet" (application No. 111202253), are only introduced in their entirety as part of the specification of the present disclosure.

Wherein, the protector 30 is electrically connected to the capacitive sensor 10 and the actuator 20. The protector 30 includes a detector 32 and a controller 31. The detector 32 detects a load variation 221 during an operation of the actuator 20 to generate a detection signal 321. The controller 31 receives the sensing signal 11 and correspondingly generates a control signal 311 to control the actuator 20 according to the sensing signal 11 and the detection signal 321.

It is worth mentioning that the detector 32 may be categorized into direct detection or indirect detection. Wherein, for direct detection, for example, the detector 32 may be a strain gauge torque sensor or a strain gauge non-contact sensor, which is substantially a measuring bridge formed of strain gauges disposed on the pressing mechanism 21. When the pressing mechanism 21 is slightly deformed by the torque, the resistance value of the bridge changes and then converted into a torque value to become the detection signal 321, wherein the application of a strain gauge torque sensor or a strain gauge non-contact sensor is well known to a person with ordinary skill in the art, so similar descriptions are not to be described herein. For direct detection, yet for another example, the detector 32 may be a magnetoelectric torque sensor or a fiber optic torque sensor, etc., which uses phase differences to calculate torque values to become the detection signal 321. Wherein, indirect detection, for example, senses voltage or current values of a driver 22 such as a motor to become the detection signal 321.

In the present embodiment, preferably, the detector 32 senses voltage or current values of the driver 22 such as a motor as an exemplary aspect, which should not be limited thereto. Furthermore, the load variation 221 is a variation in voltage or current values of the driver 22. For example, the voltage required to drive the motor varies with the rotation speed of the motor, and the current required varies with the resistance to the motor. Therefore, when the flushing switches 91 of the toilet 90 has a pressing stroke smaller than the pressing stroke of the driver 22 that drives the pressing mechanism 21, resistance is increased with fluctuation gradually, thus changing the current accordingly. For example, when the pressing stroke of the flushing switches 91 of the toilet 90 has reached the end and the pressing stroke of the driver 22 that drives the pressing mechanism 21 still continues to be pressed, the current value is greater than the originally performed current value of the driver 22. The main purpose of the present disclosure is to adjust the pressing stroke of the driver 22 to drive the pressing mechanism 21 with the use of the variation in voltage or current values.

Furthermore, in the present embodiment, the protector 30 includes a detection mode 301 and an operational mode 302. Wherein, the detection mode 301 refers to the driver 22 that drives the pressing stroke of the pressing mechanism 21 firstly to obtain the operational information 303 corresponding to the flushing stroke of the flushing switches 91 of the toilet 90, which is then stored. In this way, during the operational mode 302, the controller 31 controls the actuator 20 according to the sensing signal 11 and the control signal 311 corresponding to the operational information 303.

Wherein, during the detection mode 301, the controller 31 stores operational information 303 at the load variation 221, and the operational information 303 includes a time value 3032 from a start of an operation to a variation in current values. The controller 31 correspondingly generates the control signal 311 to control the actuator 20 according to the sensing signal 11 and the time value 3032, or correspondingly generates the control signal 311 to control the actuator 20 according to the sensing signal 11 and the current value at the time of variation 3031 and the time value 3032.

The controller 31 includes operations such as pressing one of the flushing switches 91 or another flushing switch 91 of the toilet 90 according to the sensing signal 11 to generate a corresponding part of the control signal 311; another corresponding part of the control signal 311 is generated according to the operational information 303 (the current value at the time of variation 3031 and/or the time value 3032 from a start of an operation to a variation in current values). Furthermore, the aforementioned two parts of the control signal 311 are combined into the control signal 311 that actually operates.

It is worth mentioning that the detection mode 301 may be performed when the flushing switch device with automatic pressing stroke detection 1 is operated for the first time or by gesture control. Rather, in the follow-up process (that is, the operational mode 302), it does not need to be performed; in other words, the detector 32 does not need to be in operation.

Figure 2:
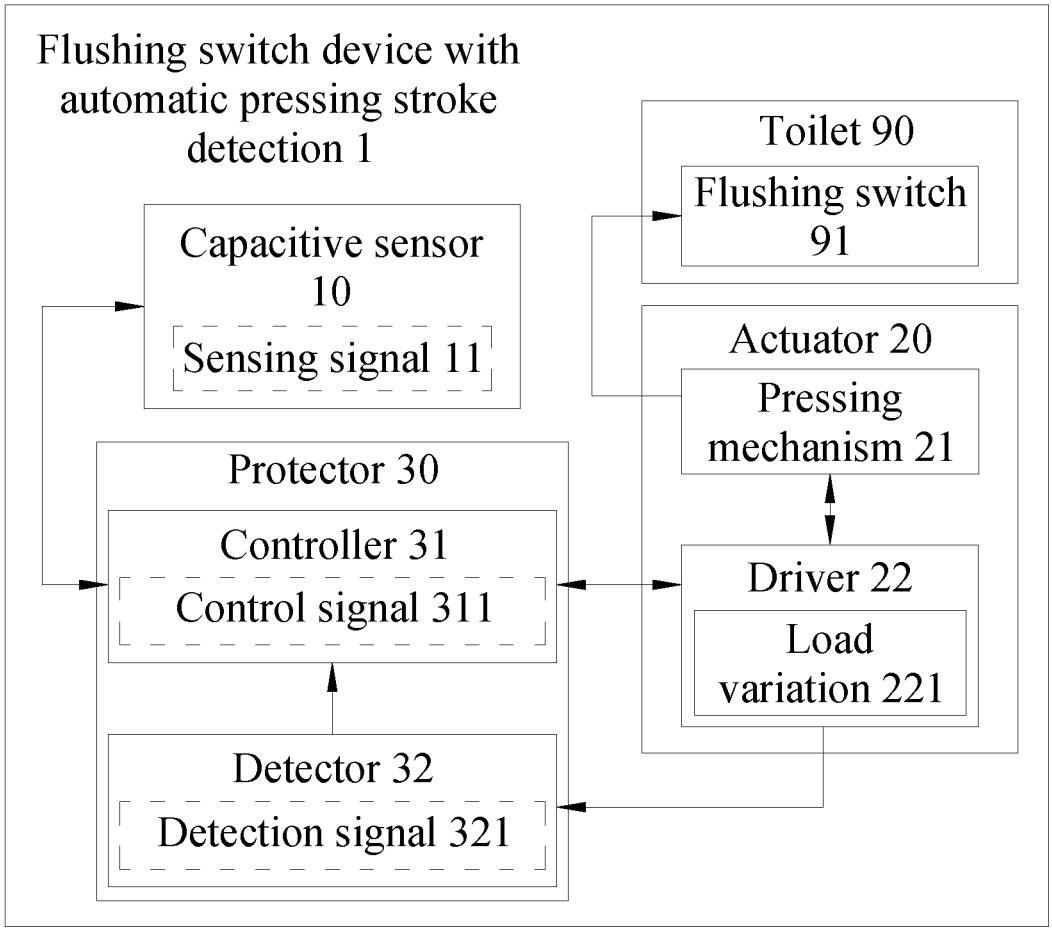
FIG. 2 is a schematic block diagram of the flushing switch device with automatic pressing stroke detection according to the second embodiment of the present disclosure.

Please refer to FIG. 2. FIG. 2 is a schematic block diagram of the flushing switch device with automatic pressing stroke detection according to the second embodiment of the present disclosure.

In the present embodiment, the configuration and operation of the elements of the same symbol are the same as or similar to those described in the previous embodiments, so the same or similar descriptions are not to be repeated herein.

The main difference between the present embodiment and the previous embodiment is that in the present embodiment, the protector 30 does not include the detection mode 301 and the operational mode 302.

Furthermore, the detector 32 operates during each operation of the flushing switch device with automatic pressing stroke detection 1 to detect load variations 221. Wherein, the load variation 221 is a variation in voltage or current values of the driver 22. When the controller 31 determines a variation in current values to be the current values greater than the originally performed current values of the driver 22, the controller controls the driver 22 to stop operation.

In summary, the flushing switch device with automatic pressing stroke detection of the present disclosure may be installed on the flushing switches of toilets for flushing by pressing the flushing switches of toilets without making contact. Furthermore, with the configuration of the protector, the present disclosure may be used for toilets with different models or specifications, which may avoid the problem of overload and damage to a driver such as a motor.

The above description is merely illustrative rather than restrictive. Any equivalent modifications or alterations without departing from the spirit and scope of the present disclosure are intended to be included in the following claims.

What is claimed is:

1. A flushing switch device with automatic pressing stroke detection for pressing two flushing switches of a toilet, wherein the two flushing switches respectively correspond to different flushing amounts of water, and the flushing switch device with automatic pressing stroke detection comprises:

a capacitive sensor, configured to sense a user's hand movements to generate a sensing signal;

a actuator, comprising a driver and a pressing mechanism, the driver configured to drive the pressing mechanism to press one of the flushing switches; and a protector, configured to be electrically connected to the capacitive sensor and the actuator, the protector comprising a detector and a controller, the detector detecting a load variation during an operation of the actuator to generate a detection signal, the controller receiving the sensing signal and correspondingly generating a control signal to control the actuator according to the sensing signal and the detection signal.

2. The flushing switch device with automatic pressing stroke detection according to claim 1, wherein the protector comprises a detection mode and an operational mode; when in the detection mode, the controller stores operational information at the load variation, and when in the operational mode, the controller controls the actuator according to the sensing signal and the control signal corresponding to the operational information.

3. The flushing switch device with automatic pressing stroke detection according to claim 1, wherein the load variation is a variation in voltage or current values of the driver.

4. The flushing switch device with automatic pressing stroke detection according to claim 1, wherein the operational information comprises a time value from a start of an operation to a variation in voltage or current values, and the controller correspondingly generates the control signal to control the actuator according to the sensing signal and the time value.

5. The flushing switch device with automatic pressing stroke detection according to claim 1, wherein the load variation is a variation in voltage or current values of the driver, and when the controller determines a variation in voltage or current values to be the voltage or current values greater than originally performed current values of the driver, the controller controls the driver to stop operation.

* * * * *